United States Patent [19]

Shaffer et al.

[11] Patent Number: 4,696,641

[45] Date of Patent: Sep. 29, 1987

[54] PRIMER MATERIAL AND PHOTOFLASH LAMP

[75] Inventors: John W. Shaffer, Montoursville; Ronald E. Sindlinger, Muncy, both of Pa.

[73] Assignee: GTE Products Corporation, Danvers, Mass.

[21] Appl. No.: 895,555

[22] Filed: Aug. 11, 1986

[51] Int. Cl.[4] ..... F21K 5/02

[52] U.S. Cl. ..... 431/362; 149/37

[58] Field of Search ..... 431/362; 149/37, 38; 445/28; 102/202.5, 202.9

[56] References Cited

U.S. PATENT DOCUMENTS 3,685,947 8/1972 Meulemans et al. ..... 431/362

3,816,054 6/1974 Baldrige et al. ..... 431/362

3,823,994 7/1974 De Graaf et al. ..... 431/362 X 3,884,615 5/1975 Sobieski ..... 431/362

4,229,161 10/1980 Bouchard et al. ..... 431/362

4,315,733 2/1982 Bouchard et al. ..... 431/362

*Primary Examiner*—Margaret A. Focarfino

*Attorney, Agent, or Firm*—Martha Ann Finnegan

[57] ABSTRACT

An improved primer material for use in a high-voltage photoflash lamp is provided. The primer material includes electrically insulating beads which have been coated with a friction-reducing material. The primer also includes an oxidizing agent, and a binder, and a combustible metal powder, part of the combustible metal powder being in larger particle form. A high-voltage photoflash lamp including the improved primer material of the present invention is also disclosed.

24 Claims, 2 Drawing Figures

PRIMER MATERIAL AND PHOTOFLASH LAMP

BACKGROUND OF THE INVENTION

The present invention relates to photoflash lamps and more particularly to high-voltage photoflash lamps.

A high-voltage flash lamp typically includes a glass envelope with a combustion-supporting gas and a quantity of filamentary, combustible material therein. A pair of electrically conductive lead wires is usually sealed in one end of the envelope and extend within the envelope. Medial portions of the extending ends of the lamp's conducting wires are located within a glass or ceramic bead. Primer material serves to bridge the portions of the ends which project through the bead. Flashing is accomplished by a firing pulse approaching a few thousand volts which is provided by a piezoelectric element. In another type of high-voltage lamp, the primer is located within an indentation in the bottom of the lamp and the conductive wires extend therein.

Understandably, it is highly desirous to prevent shred interference with the lamp's ignition. Shred interference can occur primarily in one of two ways: either by the shreds contacting and shorting the exposed portions of the lead wires within the envelope or by the shreds contacting and lying across the primer material surface.

In either case, the ignition voltage characteristics are altered, which in some instances can even prevent the lamp from firing. Shred interference can also reduce the firing voltage to the point that ignition is possible electrostatically. In situations wherein the lamp is used in circuitry containing several other lamps (e.g., sequential or random flash embodiments), an altered ignition voltage substantially reduces the lamp's compatibility with the desired circuit.

Various techniques for preventing shred interference with a lamp's ignition are illustrated. For example, in U.S. Pat. Nos. 3,884,615 and 3,685,947 a hollow glass bead is supported by the inner ends of the lead wires and primeer is put into the cavity of the bead to electrically connect the two lead wires. This construction is bulky and does not permit miniaturization of the flash lamp. In addition, the beads are costly, and their mass, which is relatively isolated from the bulb, interferes with rapid cool down and liquefaction of oxygen, thereby limiting machine speeds.

In U.S. Pat. Nos. 3,823,994 and 3,627,459, the inner ends of the lead wires are exposed inside a small length of glass tubing which is sealed into the press. A quantity of primer within the tube connects the two lead wires electrically. This construction is costly in that it requires small pieces of fabricated glass tubing.

U.S. Pat. No. 4,229,161 teaches the use of a device, such as a disc of mica, to isolate electrically the shreds in the lamp from the primer. The beaded construction is also shown. Both the bead and the mica disc add considerably to the cost of the lamp and the the difficulty of cooling the lamp and thereby pressuring the lamp with oxygen.

U.S. patent application Ser. No. 807,400 of Ronald E. Sindlinger for "Photoflash Lamp with Improved Primer", filed Dec. 10, 1985, and now U.S. Pat. No. 4,659,308 teaches the use of a primer including a combustible metal powder wherein at least part of the powder is in large particle form and solid electrically insulating beads to better insulate the internal leads of the lamp from the shred fill. The use of large particle form combustible metal powder with the electrically insulating beads essentially eliminates high voltage breakdown which occurs when electrically insulating beads are used with combustible metal powder all of which has an average particle size.

While the improved primer taught in Ser. No. 807,400 provides a photoflash lamp with improved reliability due to improved insulating of the internal leads from the shred fill and the essential elimination of high voltage breakdown, difficulty is encountered in applying the bead-containing primer to the lamp envelope. Primer is preferably added to the open-ended photoflash lamp envelope through a hollow needle dispense system. Such systems are preferred because they exclude air contact from the primer and prevent premature evaporation of the solvent from the primer. FIG. 1 is a schematic illustration of a portion of a hollow needle dispense system. In FIG. 1, the hollow needle portion 1 of a primer dispense device 3 is positioned within an open-ended lamp envelope 5. The primer dispense device contains a reservoir of primer (not shown). The hollow needle 1 of the primer dispense system delivers a predetermined amount of wet primer 7 (i.e., primer containing a volatilizable solvent) into the open-ended lamp 5. The primer then bridges the lead wires, 8 and 9, of the photoflash lamp.

When the needle dispense system is used with bead-containing primer, the beads become lodged in the hollow needle portion and, within a short period of time, totally block or clog the needle portion of the dispenser. Before the needle is totally blocked, wet primer not containing beads is forced between the lodged beads and dispensed into the lamp, resulting in non-uniform primer material in the lamps.

A photoflash lamp primer with high reliability and substantially consistent breakdown voltage and which can be applied to the lamp envelope with reduced difficulty and a photoflash lamp with improved manufacturability would represent an advancement in the photoflash art.

SUMMARY OF THE INVENTION

In accordance with the present invention there is provided an improved primer material for a photoflash lamp comprising a mixture of a combustible metal powder, part of said powder being in large particle form; an oxidizer; a binding agent; and solid electrically insulating beads, said beads being coated with a layer of friction-reducing material.

In accordance with another aspect of the present invention there is provided a high-voltage photoflash lamp comprising an hermetically-sealed light-transmitting envelope including a combustion-supporting atmosphere therein; a quantity of filamentary combustible material located within said envelope; ignition means for igniting said combustible material, said ignition means including a pair of electrical conductors sealed within said envelope and projecting therefrom, each of said conductors including an end portion having access to the interior of said envelope; a mass of primer located within said envelope in electrical contact with said end portions of said electrical conductors, said primer material comprising a mixture of a combustible metal powder, part of said powder being in large particle form; an oxidizer; a binding agent; and solid electrically insulating beads, said beads being coated with a layer of friction-reducing material.

Figure 1:
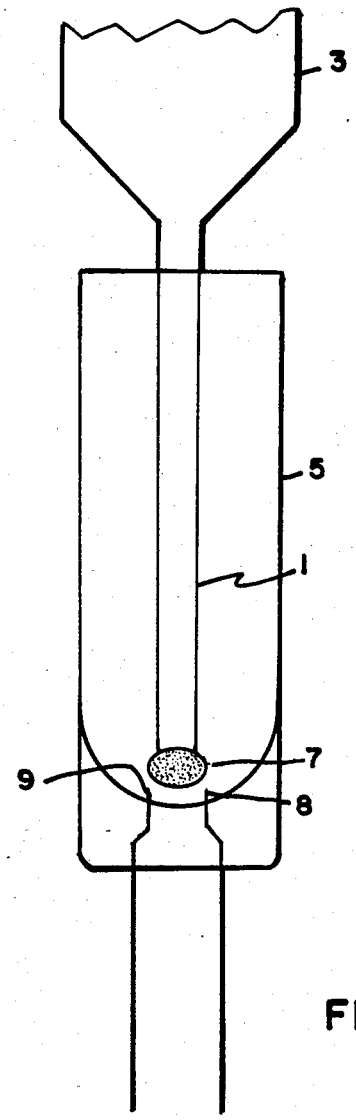
FIG. 1 schematically illustrates the hollow needle portion of a primer dispense system in use.

For a better understanding of the present invention together with other and further objects, advantages, and capabilities thereof, reference is made to the following disclosure and appended claims in connection with the above-described drawing.

DETAILED DESCRIPTION OF THE INVENTION

In accordance with the present invention, there is provided an improved primer for use in a photoflash lamp. The improved primer of the present invention greatly facilitates application of the primer material to the open-ended lamp envelope, thereby significantly increasing the manufacturablity of the flashlamps which include it. The primer of the present invention comprises a mixture of a combustible metal powder, part of the combustible metal powder being in large particle form; an oxidizer; a binding agent; and solid electrically insulating beads, the surface of the beads being coated with a friction-reducing material. Preferably the thickness of the friction-reducing layer is essentially monomolecular.

The presence of the friction-reducing coating on the electrically insulating beads permits the coated beads to freely slide over one another and over other surfaces, such as the inner surfaces of the primer dispensing system used in photoflash lamp manufacture. The use of the coated beads in the primer of the present invention with the preferred hollow needle dispense system substantially eliminates machine shutdown caused by primer dispense needle clogging.

The primer of the present invention further substantially eliminates the problem of dispensing non-uniform primer to the open-ended photoflash lamp envelope which occurs when uncoated beads are used; the uncoated beads lodge in the dispenser and primer is forced through the spaces between lodged beads causing primer to be delivered to the envelope without beads. The friction-reducing layer which coats the beads used in the primer of the present invention promotes lubricity of the beads and substantially eliminates the manufacturing problems encountered when uncoated beads are used.

Examples of materials suitable for use as the friction-reducing coating include organosilane compounds such as trimethylchorosilane, beta-(3,4-epoxycyclohexyl)ethyltrimethoxysilane, gamma-glycidoxypropyltrimethoxysilane, gamma-aminopropyltrimethoxysilane, and N-beta-(aminoethyl)-gamma-amino-propyltrimethoxysilane and silicones. Other suitable coating materials having similar characteristics could be readily identified by those of ordinary skill in the art and used as the friction-reducing coating of the present invention.

Preferably the coating material is chosen such that the excellent adhesion between the binder of the primer and uncoated beads is not destroyed. Of the foregoing specific examples of suitable coating materials, beta-(3,4-epoxycyclohexyl)ethyltrimethoxysilane, gamma-glycidoxypropyltrimethoxysilane, gamma-aminopropyltriethoxysilane, and N-beta-(aminoethyl)-gamma-amino-propyltrimethoxysilane, are preferred because they permit bonding between the coated beads and binders such as polyvinylpyrrolidone.

Figure 2:
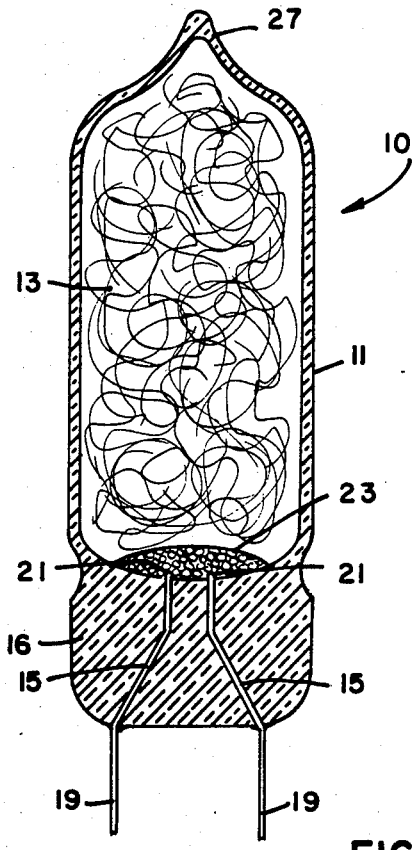
FIG. 2 illustrates an embodiment of a high-voltage photoflash lamp in accordance with the present invention.

With particular attention to FIG. 2, there is shown a photoflash lamp 10 which comprises an hermetically-sealed, light-transmitting envelope 11 having a combustion-supporting atmosphere and a quantity of combustible filamentary material 13 therein. Envelope 11 is manufactured from a tubular glass (e.g., lime glass) member having opposing ends. A pair of spaced-apart electrical conductors 15 are press-sealed within one end (16) of the tubular glass member such that portions 19 of these conductors project externally therefrom. Conductors 15 also include end portions 21 which have access to the interior of the envelope 11 such that a mass of primer material 23 may be placed in electrical contact therewith. Conductors 15 and primer 23 comprise the means for igniting combustible material 13 when an electrical pulse is applied thereto. Both of the conductors 15 are buried in the primer 23, rather than having one conductor extend into the combustible material 13.

The pulse is preferably supplied by a piezoelectric element (not shown) located externally of lamp 10. Application of the pulse across the conductors 15 resuslts in intense deflagration of primer 23, which in turn ignites the main charge of the lamp, i.e., combustible material 13.

As stated, envelope 11 is glass. The primer comprises a mixture of a combustible metal powder, part of the combustible metal powder being in large particle form; an oxidizer; a binding agent; and a quantity of electrically insulating beads, the outer surface of the beads being coated with a layer of friction-reducing material, such as organosilane material which has been dried on the outer surface of the beads or a silicone material which has been dried on the outer surface of the beads. The quantity of the coated electrically insulating beads in the primer preferably represents from about 35 to about 65 weight percent of the primer. Preferably the ratio of the weight percent of the coated electrically insulating beads in the primer to the weight percent of the large particle form combustible metal powder in the primer is from about 5 to 1 to about 10 to 1. Large particle form combustible metal powder has an average particle size (diameter) greater than about 2 microns. Preferably the large particle metal powder has an average particle size (diameter) greater than about 2 microns and less than about 10 microns. The total weight percent of combustible metal powder in the primer is preferably from about 30 to about 50 weight percent. Typical amounts of oxidizer and binding agent in the primer are used in the present primer composition. For example, the typical amounts of binder (e.g., nitrocellulose or polyvinylpyrrolidone) are from about 0.5 to about 3 weight percent; typical amounts of oxidizer are from about 3 to 12 weight percent. The most preferred primer material 23 is a mixture of approximately 7 weight percent zirconium powder with an average particle size (diameter) of greater than about 2 to about 3 microns (large particle), approximately 32 weight percent zirconium powder with an average particle size from about 1 to about 2 microns, approximately 9 weight percent potassium perchlorate (oxidizer), approximately 1 weight percent polyvinylpyrrolidone (binder), and approximately 50 weight percent solid glass beads having an average diameter of about 0.008 inches, the beads being coated with a friction-reducing layer comprising an organosilane or silicone compound.

Conductors 15 are preferably 0.016 inch diameter wires comprising a nickel-iron alloy. The points at which the two wires emerge from the envelope are preferably located about 0.150 inches apart. The preferred combustible material 13 is shredded zirconium or hafnium, while the preferred supporting atmosphere is oxygen. Typically, the oxygen is established at a pressure of several atmospheres.

The presence of the coated electrically insulating beads in the primer insulates the shredded fill from the internal leads in a photoflash lamp thereby reducing interference with lamp firing. The friction-reducing coating on the beads is selected such that it does not interfere with the electrical characteristics of the primer.

The beads used in the primer have an average diameter from about 0.005 inches to about 0.020 inches. The electrical path in the lamp is lengthened when the coated solid electrically insulating beads are mixed into a conventional primer of zirconium, potassium perchlorate and nitrocellulose, wherein all of the zirconium powder has an average particle size within the same particle size range of approximately 1–2 microns. Such elongated electrical path promotes very high voltage breakdown which is extremely undesirable in a high-voltage photoflash lamp. High voltage breakdown causes lamp failures because the voltage needed to flash the lamp may exceed that provided by the camera. Such breakdown is essentially eliminated when part of the combustible metal powder is in large particle form. The primer material is added to the tubular glass member in liquid condition. The liquid condition is achieved by adding a suitable solvent to the primer material mixture. A suitable solvent in one which can be fully evaporated under the time and temperature conditions selected for the drying step of the lamp fabrication process. After the primer material is provided in the tubular glass member, using, e.g., a hollow needle dispense system, and the solvent is evaporated, the shredded combustible material is positioned in the lamp, and the opposing end 27 of the glass tubing is sealed to define the ultimate configuration of the envelope 11. The preferred method for effecting this seal involves a tipping operation well known in the photoflash lamp art. Such high voltage breakdown is essentially eliminated by the present primer composition.

EXAMPLE

A high-voltage flash lamp having a light-transmitting envelope with a 5.2 mm inside diameter and a volume of about 0.30 $cm^3$ was fabricated.

A pair of lead-in wires was sealed into a first end of an elongated light-transmitting tube such that one end of each lead-in wire extended to the exterior of the sealed end and the opposing end of each lead wire extended into the interior of the glass tube. The ends of the lead-in wires extending into the interior of the tubular glass member extend into the envelope a distance approximately equal to the diameter of a single lead-in wire, i.e., approximately 0.016 inches. The lead-in wires (51% by weight of Ni. and 41% by weight of Fe) had a diameter of about 4.1 mm. A quantity of primer in liquid condition, i.e., a mixture of solvent and primer was positioned within the tube through the second open end thereof using a hollow needle primer dispenser system. The primer - solvent mixture included 3.1 weight percent propylene glycol, 9.2 weight percent dipropylene glycol monomethylether, 2.1 weight percent distilled water, 1.0 weight percent polyvinylpyrrolidone, 7.4 weight percent potassium perchlorate, 34.1 weight percent zirconium, (about one-fifth of the total zirconium or 6.4 percent of the primer-solvent mixture was large particle zirconium); and 43.0 weight percent coated glass beads. The beads used in the primer of this Example were obtained precoated with a layer of CP-03 from Potter's Industries Incorporated of Carlstadt, N.J. 07070. The solvent was evaporated from the mixture and blown off by heating with gradual increase in temperature over an approximately 30–45 second time period. Gradual heating is used to remove the water component of the mixture essentially first, the dipropylene glycolmethyl monomethylether component of the mixture essentially second, and the propylene glycol component of the mixture last. (The water component evaporates at about 100° C.; the dipropylene glycol monomethylether component evaporates at about 167° C.; and the propylene glycol component evaporates at about 214° C.) After the propylene glycol, dipropylene glycolmethyl monomethylether, and distilled water solvent mixture was evaporated, the approximately 4 mg of dried primer consisted of 50.3% by weight of CP-03 coated electrically insulating beads, 39.9% by weight zirconium, about one-fifth of the total zirconium, or 7.5% by weight of the total primer was large particle zirconium; 8.7% by weight potassium perchlorate; and 1.1% by weight polyvinylpyrrolidone. The large particle zirconium used in the present example had an average particle size greater than about 2 to about 3 microns. The balance of the zirconium powder had an average particle size of about 1 to about 2 microns, which particle size is conventionally used in primer material. the weight percent ratio of the coated glass beads to the large particle zirconium was about 7 to 1. The beads used were solid glass beads having a diameter of about 200 microns and had an average density of 2.47 $g/cm^3$.

A quantity of 10 mg zirconium shreds was positioned in the glass tube and the oxygen gas was introduced therein after which the second open end was sealed to form the envelope of the finished lamp.

Thus there has been shown and described an improved primer for use in a photoflash lamp which significantly improves and increases the manufacturability of such lamps. A photoflash lamp including the improved primer and method of making this lamp has also been described.

While there have been shown and described what are at present considered the preferred embodiments of the invention, it will be obvious to those skilled in the art that various changes and modifications may be made therein without departing from the scope of the invention as defined by the appended claims.

What is claimed is:

1. A primer material for a photoflash lamp comprising a mixture of a combustible metal powder, part of said powder being in large particle form; an oxidizer; a binding agent; and solid electrically insulating beads, said beads being coated with a layer of friction-reducing material.

2. A primer material in accordance with claim 1 wherein the electrically insulating beads are coated with an organosilane compound or a silicone compound.

3. A primer material in accordance with claim 1 wherein the electrically insulating beads are coated with beta-(3,4-epoxycyclohexyl)ethyltrimethoxysilane.

4. A primer material in accordance with claim 1 wherein the electrically insulating beads are coated with trimethylchorosilane.

5. A primer material in accordance with claim 1 wherein the electrically insulating beads are coated with gamma-glycidoxypropylttimethoxysilane.

6. A primer material in accordance with claim 1 wherein the electrically insulating beads are coated with gamma-aminopropyltrimethoxysilane.

7. A primer material in accordance with claim 1 wherein the electrically insulating beads are coated with N-beta-(aminoethyl)-gamma-aminopropyltrimethoxysilane.

8. A primer material in accordance with claim 2 wherein the beads coated with a friction-reducing silane compound have an average diameter from about 0.005 inches to about 0.020 inches.

9. A primer material in accordance with claim 1 wherein the solid electrically insulating beads coated with a friction-reducing material are present in an amount from about 35 to about 65 weight percent of the primer material.

10. A primer material in accordance with claim 9 wherein weight percent ratio of electrically insulating beads coated with a friction-reducing material to large particle combustible metal powder is from about 5 to 1 to about 10 to 1.

11. A high-voltage photoflash lamp comprising:

an hermetically-sealed light-transmitting envelope including a combustion-supporting atmosphere therein;

a quantity of filamentary combustible material located within said envelope;

ignition means for igniting said combustible material, said ignition means including a pair of electrical conductors sealed within said envelope and projecting therefrom, each of said conductors including an end portion having access to the interior of said envelope;

a mass of primer material located within said envelope in electrical contact with said end portions of said electrical conductors, said primer material comprising a mixture of a combustible metal powder, part of said powder being in large particle form; an oxidizer; a binding agent; and electrically insulating beads, said beads being coated with a friction-reducing material.

12. A high-voltage photoflash lamp in accordance with claim 11 wherein the electrically insulating beads are coated with an organosilane compound or a silicone compound.

13. A high-voltage photoflash lamp in accordance with claim 11 wherein the electrically insulating beads are coated with beta-(3,4-epoxycyclohexyl)ethyltrimethoxysilane.

14. A high-voltage photoflash lamp in accordance with claim 11 wherein the electrically insulating beads are coated with trimethylchorosilane.

15. A high-voltage photoflash lamp in accordance with claim 11 wherein the electrically insulating beads are coated with gamma-glycidoxypropyltrimethoxysilane.

16. A high-voltage photoflash lamp in accordance with claim 11 wherein the electrically insulating beads are coated with gamma-aminopropyltrimethoxysilane.

17. A high-voltage photoflash lamp in accordance with claim 11 wherein the electrically insulating beads are coated with N-beta-(aminoethyl)-gamma-aminopropyltrimethoxysilane.

18. A high-voltage photoflash lamp in accordance with claim 12 wherein the beads coated with a friction-reducing silane compound have an average diameter from about 0.005 inches to about 0.020 inches.

19. A high-voltage photoflash lamp in accordance with claim 11 wherein the solid electrically insulating beads coated with a friction-reducing material are present in an amount from about 35 to about 65 weight percent of the primer material.

20. A high-voltage photoflash lamp in accordance with claim 19 wherein weight percent ratio of electrically insulating beads coated with a friction-reducing material to large particle combustible metal powder is from about 5 to 1 to about 10 to 1.

21. A high-voltage photoflash lamp comprising:

a hermetically-sealed light-transmitting envelope including a combustion-supporting atmosphere therein;

a quantity of filamentary combustible material consisting essentially of zirconium shreds located within said envelope;

ignition means for igniting said combustible material, said ignition means including a pair of electrical conductors sealed within said envelope and projecting therefrom, each of said conductors including an end portion having access to the interior of said envelope;

a mass of primer material located within said envelope in electrical contact with said end portions of said electrical conductors, said end portions of said electrical conductors being buried in said primer material, said primer material comprising a mixture of about 40 weight percent zirconium, part of the zirconium being in large particle form having an average particle size greater than about 2 microns and less than about 10 microns; about 9 weight percent potassium perchlorate; about 1 weight percent polyvinylpyrrolidone; and about 50 weight percent glass beads, the beads being coated with a monomolecular friction-reducing layer of an organosilane compound.

22. A high-voltage photoflash lamp in accordance with claim 21 wherein the weight percent ratio of glass beads to large particle zirconium is about 7:1.

23. A high-voltage photoflash lamp in accordance with claim 21 wherein the glass beads have a diameter of about 0.005 inches to about 0.020 inches.

24. A high-voltage photoflash lamp in accordance with claim 23 wherein the large particle zirconium has an average particle size of greater than about 2 microns and less than or equal to about 3 microns.

* * * * *